US009912080B2

(12) United States Patent
Louzir et al.

(10) Patent No.: US 9,912,080 B2
(45) Date of Patent: Mar. 6, 2018

(54) MULTI-SECTOR DIRECTIVE ANTENNA

(71) Applicant: THOMSON LICENSING, Issy de Moulineaux (FR)

(72) Inventors: Ali Louzir, Rennes (FR); Mathilde Bellec, La Chapelle des Fougeretz (FR)

(73) Assignee: THOMSON LICENSING, Issy les Moulineaux (FR)

( * ) Notice: Subject to any disclaimer, the term of this patent is extended or adjusted under 35 U.S.C. 154(b) by 147 days.

(21) Appl. No.: 14/331,322

(22) Filed: Jul. 15, 2014

(65) Prior Publication Data

US 2015/0022413 A1 Jan. 22, 2015

(30) Foreign Application Priority Data

Jul. 17, 2013 (FR) ..... 13 57029

(51) Int. Cl.
*H01Q 25/00* (2006.01)
*H01Q 21/20* (2006.01)
*H01Q 19/30* (2006.01)

(52) U.S. Cl.
CPC ..... *H01Q 25/005* (2013.01); *H01Q 19/30* (2013.01); *H01Q 21/205* (2013.01)

(58) Field of Classification Search
CPC ..... H01Q 25/005; H01Q 21/205; H01Q 19/30
(Continued)

(56) References Cited

U.S. PATENT DOCUMENTS 2,908,002 A * 10/1959 Van Atta ..... H01Q 3/2647 342/370
4,514,734 A * 4/1985 Cermignani ..... H01Q 1/286 343/708

(Continued)

FOREIGN PATENT DOCUMENTS

| | | |
|---|---|---|
| EP | 0877443 | 11/1998 |
| EP | 1517398 | 3/2005 |
| JP | 2001345633 | 12/2001 |

OTHER PUBLICATIONS

Honma et al: "Compact Planar Four-Sector Antenna Comprising Microstrip Yagi-Uda Arrays in a Square Configuration", IEEE Antenna and Wireless propagation Letters, vol. 7, 2008, pp. 569-598.

(Continued)

*Primary Examiner* — Dameon E Levi
*Assistant Examiner* — Ab Salam Alkassim, Jr.
(74) *Attorney, Agent, or Firm* — Brian J. Dorini; Patricia A. Verlangieri

(57) ABSTRACT

The present invention relates to an antenna able to cover two opposite angular sectors comprising:

first and second excited elements (10,11) each able to radiate a signal beam at a predetermined frequency, at least two reflector elements (20,21,22,23), called first and second reflector elements, able to reflect said beams in opposite directions.

According to the invention, said first and second excited elements (10,11) and said at least two reflector elements (20,21,22,23) are aligned, said reflector elements being disposed between said first and second excited elements. At least two reflector elements from among said at least two reflector elements (20,21,22,23) are connected together electrically by a first transmission line (30) of predetermined length so that the reflector elements connected together participate jointly in reflecting the beams in the two opposite directions.

12 Claims, 5 Drawing Sheets

(58) Field of Classification Search
USPC ..... 343/833, 836
See application file for complete search history.

(56) References Cited

U.S. PATENT DOCUMENTS

| | | | | | |
|---|---|---|---|---|---|
| 4,922,263 | A * | 5/1990 | Dubost | H01Q 9/065 | 343/700 MS |
| 5,220,335 | A * | 6/1993 | Huang | H01Q 19/30 | 343/700 MS |
| 5,686,928 | A * | 11/1997 | Pritchett | H01Q 1/3225 | 343/711 |
| 6,127,987 | A * | 10/2000 | Maruyama | H01Q 1/36 | 343/824 |
| 6,307,524 | B1 * | 10/2001 | Britain | H01Q 19/30 | 343/795 |
| 6,590,498 | B2 * | 7/2003 | Helms | G06K 7/0008 | 340/505 |
| 6,864,852 | B2 * | 3/2005 | Chiang | H01Q 1/246 | 343/810 |
| 6,975,278 | B2 * | 12/2005 | Song | H01Q 9/26 | 343/795 |
| 7,239,288 | B2 * | 7/2007 | Lynch | H01Q 19/32 | 343/833 |
| 7,541,988 | B2 * | 6/2009 | Sanelli | H01Q 1/523 | 343/702 |
| 7,724,200 | B2 * | 5/2010 | Kitamori | H01Q 9/285 | 343/795 |
| 9,082,307 | B2 * | 7/2015 | Sharawi | G08G 1/123 | |
| 9,147,942 | B2 * | 9/2015 | Pintos | H01Q 19/06 | |
| 9,246,235 | B2 * | 1/2016 | Smith | H01Q 19/30 | |
| 2002/0036595 | A1 * | 3/2002 | Chiang | H01Q 3/242 | 343/876 |
| 2007/0103377 | A1 * | 5/2007 | Abramov | G06F 1/1616 | 343/818 |
| 2009/0135076 | A1 * | 5/2009 | Foo | H01Q 1/246 | 343/836 |
| 2013/0027268 | A1 * | 1/2013 | Ohno | H01Q 19/30 | 343/818 |

OTHER PUBLICATIONS

Honma et al: "Compact six-sector antenna employing patch yagi-uda array with common director", 2002 DIGEST, IEEE, vol. 1, Jun. 16, 2002, pp. 26-29.

Willmot et al: "A Yagi-Uda Array of High-Efficiency Wire-Bond Antennas for On-Chip Radio Applications", IEEE, vol. 57, No. 12, Dec. 2009. pp. 3315-3321.

Maruyama et al: "Analysis and Design of Multi-Sector Monopole Yagi-Uda Array Mounted on a Ground Plane Using Moment Method", NTT Wireless Systems Labs. Apr. 10-12, 1996pp. 289-294.

Simba etal: "Planar-type sectored antenna based on slot Yagi-Uda array",Microwaves, Antennas and Propagation, IEEE Proceedings, vol. 152, No. 5, Oct. 2005, pp. 347-353.

Lim etal:"Design of a multidirectional, high-gain compact Yagi antenna",IEEE Antennas and Wireless Propagation Letters | vol. 8 | pp. 418-420, 2009.

Search Report dated Apr. 4, 2014.

Bellec et al., "Ultra-compact 4-sector antenna system based on modified Van Atta array", 2013 IEEE International Symposium on Antennas and Propagation, Orlando, Florida, USA, Jul. 7, 2013, pp. 582-583.

Pintos et al., "Ultra Compact Multi-Sector Antenna System using Retro-directive Array Concept", 2011 IEEE International Symposium on Antennas and Propagation (APSURSI), Spokane, Washington, USA, Jul. 3, 2011, pp. 1211-1214.

Anonymous, "Yagi-Uda antenna", http://yagi-uda.com/, Dec. 1, 2011, pp. 1-2.

* cited by examiner

MULTI-SECTOR DIRECTIVE ANTENNA

This application claims the benefit, under 35 U.S.C. § 119 of French Patent Application No. 1357029, filed Jul. 17, 2013.

TECHNICAL FIELD

The present invention relates to a compact multi-sector antenna. The invention finds applications in numerous products, notably in wireless communication devices such as multimedia terminals, wireless sensors and wireless cameras.

PRIOR ART

The use of directive antennas in wireless communication systems has numerous advantages. The directivity of antennas makes it possible, among other things, to reduce the interference on the transmission side by transmitting the signal only in the desired direction, also to reduce the interference on the reception side by capturing only the signals from a preferred direction and lastly to reduce the electrical consumption and the operating cost of the system.

However, their use is not yet very widespread in devices of small size due to their dimensions. In fact, the size of the antenna increases with the directivity. Moreover, the use of directive antennas requires, for numerous applications, means for aligning beams or the use of a multiple directive beam antenna for 360° coverage of space, which exacerbates the problem of the size of these antennas.

One of the most well known and cheapest directive antennas is the Yagi Uda antenna (named after its inventors). FIG. 1 diagrammatically shows the structure of a Yagi Uda antenna. This antenna is constituted of a plurality of coupled parallel electric dipoles. One of the dipoles, called excited element 1, is fed by a signal from a transmitter or receiver. It has a length substantially equal to $\lambda/2$ where $\lambda$ is the wavelength associated with the working frequency of the antenna. Another dipole, called reflector element 2, having a length slightly greater than that of the excited element, is placed at a distance of $\lambda/4$ from the excited element and plays the role of beam reflector. Finally, the other dipoles, called director elements 3, are disposed on the other side of the excited element and play the role of beam directors. They have a length slightly less than that of the excited element 1 and are separated from each other by a distance of around $0.15\lambda$. The first director element is placed at a distance of around $0.15\lambda$ from the excited element 1. The directivity of the antenna is linked to the number of director elements 3 of the antenna.

Since Messrs Yagi and Uda developed this antenna, numerous variations of this antenna have been proposed. They include notably printed circuit technology or wired antennas, or a mixture of both technologies. In certain embodiments, the dipoles have been replaced with monopoles on the ground plane.

In order to obtain multi-beam antenna systems able to transmit or receive several beams simultaneously, it has been proposed to dispose radially a plurality of Yagi Uda antennas as shown in FIGS. 2A and 2B, the structure of each Yagi Uda antenna being equivalent to the structure of FIG. 1 and the dipoles being replaced with monopoles on the ground plane.

Although very simple, this structure has the disadvantage of being too large. In fact, the diameter of such a multi-sector antenna operating at a frequency of 5 GHz and having a directivity of 10 dB per sector can be reckoned to be 20 centimeters. This diameter is much too high for wireless portable devices.

Another antenna is described in the document entitled "Compact Six-Sector Antenna Employing Patch Yagi-Uda Array with Common Director" by Naoki Honma, Fumio Kira, Tamami Maruyama, Keizo Cho, and Hideki Mizuno, NTT Network Innovation Laboratories, APS 2002. In this document, the monopoles are replaced with slots arranged in the ground plane. Although the antenna has been made for a working frequency of 10 GHz, it can be reckoned that a same antenna resonating at 5 GHz would have a diameter of 22 centimeters, which is even higher than the antenna of FIGS. 2A and 2B.

Solutions have been proposed to reduce the size of these multi-sector antennas. These solutions are based on sharing reflectors or/and directors between several beams. One of these solutions is shown in FIG. 3. In this example, the monopoles are replaced with patches disposed on a substrate with ground plane.

In this solution, the patches are disposed in a star around a central patch. Each arm comprises two patches and the star comprises six arms corresponding to six sectors to be covered. The patch disposed at the free end of each arm can be fed by a transmitter/receiver so as to form an excited element 1. When it is not fed, it can be used as a director element. The other patches are systematically used as director elements.

This antenna can transmit a beam in 6 (pairwise opposite) sectors. This structure enables the use of common director elements for two opposite sectors. This has the effect of approximately halving the size of the antenna. However, this size still remains large, namely in the order of 11 centimeters at 5 GHz for a moderate directivity per sector.

This antenna has at least two other disadvantages. A first disadvantage is that two opposite sectors of the antenna cannot be activated simultaneously. The second disadvantage is that the coupling between two opposite sectors is very high since the excited element of one of the sectors radiates to the excited element of the other. Moreover, according to the width of the beam of a sector, the coupling between this sector and the neighbouring sectors of the opposite sector (for example, sector 2 and sectors 4 and 6) can be very significant, which may discourage the use of this solution in applications requiring transmissions of simultaneous beams.

SUMMARY OF THE INVENTION

One purpose of the invention is to propose a multi-sector antenna which is compact.

Another purpose of the invention is to propose an antenna which can simultaneously transmit or receive the beams in several sectors, notably in opposite sectors.

For this purpose, the invention proposes an antenna able to cover two opposite angular sectors comprising first and second excited elements each able to radiate a signal beam at a predetermined frequency and connected respectively to first and second signal feed terminals, and at least two reflector elements, called first and second reflector elements, able to reflect said beams in opposite directions.

According to the invention, the first and second excited elements and said at least two reflector elements are aligned, said at least two reflector elements being disposed between said first and second excited elements, and at least two reflector elements from among said at least two reflector elements are connected together electrically by a first transmission line of predetermined length so that the reflector elements connected together participate jointly in reflecting the beams in the two opposite directions.

Thus, according to the invention, the two reflector elements both help to reflect the two signal beams in opposite directions, which makes it possible to reduce the number of reflector elements of the antenna. No director element in the transmission path of the beam is necessary.

Advantageously, the distance between the reflector elements connected together and the length of the first transmission line are determined so that the radiation reflected by said first and second reflector elements is in phase in each of the opposite directions. The two reflector elements thus optimally reflect the two beams.

Advantageously, said first and second reflector elements are disposed at a distance $d_1$ from said first and second excited elements respectively, $d_1$ being less than $\lambda/5$, $\lambda$ being the wavelength corresponding to the predetermined frequency.

Advantageously, the antenna also comprises third and fourth reflector elements aligned with said first and second reflector elements and disposed between said first and second excited elements, said third and fourth reflector elements being electrically connected by a second transmission line of predetermined length, the distance between the third and fourth reflector elements and the length of the second transmission line being determined so that the radiation reflected by said third and fourth reflector elements is in phase in each of the opposite directions. The number of reflector elements is doubled in this case, which helps to increase the directivity of the antenna.

According to an embodiment, the third reflector element is disposed between said first and second reflector elements and the fourth reflector element is disposed between the second reflector element and the second excited element.

Advantageously, the reflector elements are disposed at regular intervals between said first and second excited elements.

According to another embodiment, the third and fourth reflector elements are disposed between said second reflector element and said second excited element, the distance between said second and third reflector elements being less than $\lambda/5$.

According to another embodiment, the third and fourth reflector elements are disposed between said first and second reflector elements.

In all these embodiments with four reflector elements, the distance between the reflector elements and the length of the transmission lines are determined so that the radiation from the four reflector elements has substantially the same phase.

According to another embodiment, the antenna also comprises at least one director element to direct at least one of the beams in one of said opposite directions.

The invention also relates to an antenna system characterised in that it comprises at least two antennas as previously defined, said antennas being angularly offset so as to radiate beams in at least four pairwise opposite directions.

Other advantages may also occur to those skilled in the art upon reading the examples below, illustrated by the annexed figures, given by way of illustration.

DESCRIPTION OF THE INVENTION

In antenna systems of Yagi Uda type, antennas generally comprise only one reflector element. In fact, the introduction of a second reflector element behind the reflector element disposed near the excited element would provide nothing in terms of directivity since this second reflector element would only be slightly excited as the radiation would occur in the opposite direction. It would therefore contribute little to the radiation pattern of the antenna.

According to the invention, a multi-sector antenna comprising at least two excited elements and at least two reflectors electrically connected by a transmission line, the reflector elements in this case both contributing to the radiation pattern of the antenna in two opposite directions and making it possible to obtain an antenna which is very directive in these two directions.

The transmission line is dimensioned so that the radiation from the two reflector elements has the same phase for the frequency considered. Each of the two reflector elements is disposed near an excited element so as to influence the radiation pattern of the antenna sufficiently. Each reflector element is placed at a maximum distance of $\lambda/5$ from the excited element and preferably at a distance in the order of $\lambda/10$ from the excited element, $\lambda$ being the wavelength of the signals transmitted or received by the antenna.

Various embodiments have been developed on this principle.

Figure 1:
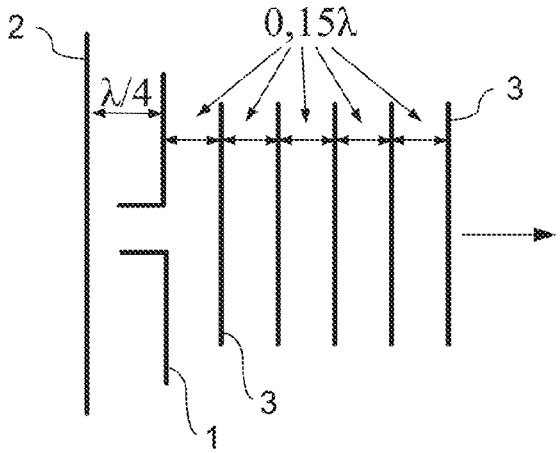
FIG. 1 shows a diagram of a standard electric dipole-based Yagi-Uda antenna.
Figure 2A:
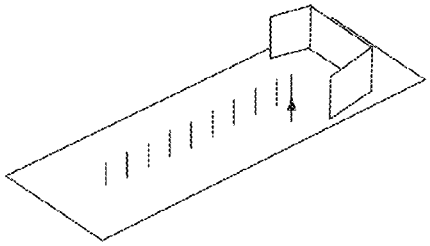
FIG. 2 shows a diagram of a standard electric monopole-based Yagi-Uda antenna.
FIG. 2*b* shows a multi-sector antenna comprising a plurality of antennas of Yagi-Uda type as shown in FIG. 2*a;*
Figure 2B:
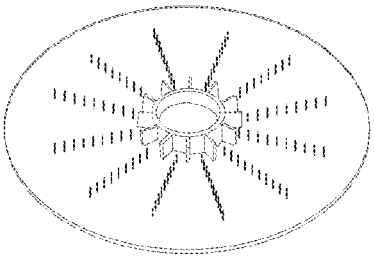
Figure 3:
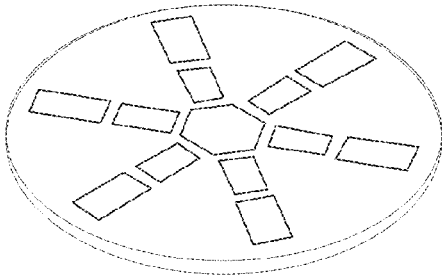
FIG. 3 is a diagram of a second known multi-sector antenna, said antenna being patch antenna based.
Figure 4:
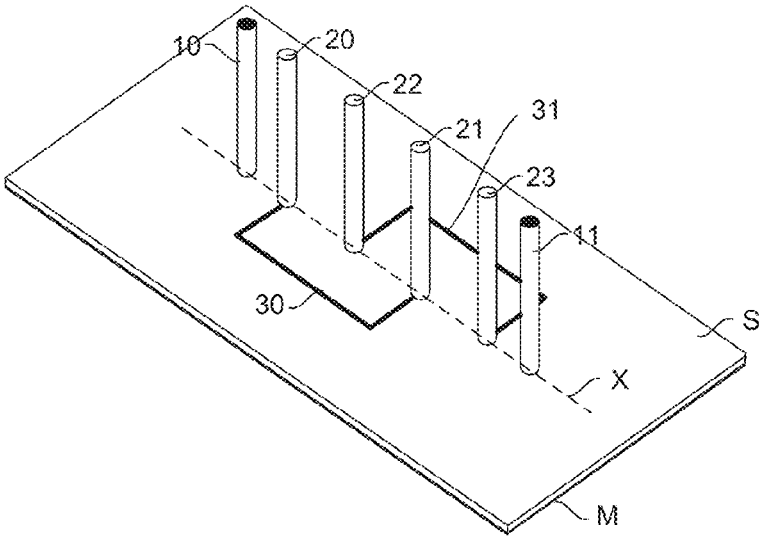
FIG. 4 is a perspective diagram of a multi-sector antenna according to a first embodiment of the invention.
Figure 5:
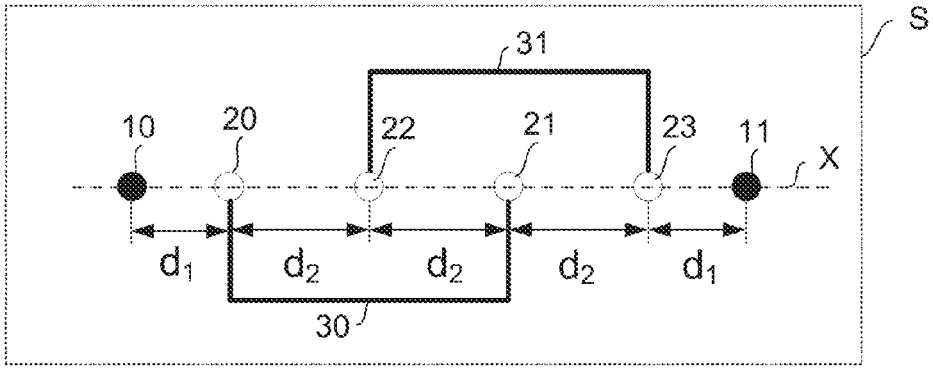
FIG. 5 is a top view of the diagram of FIG. 4.
Figure 6:
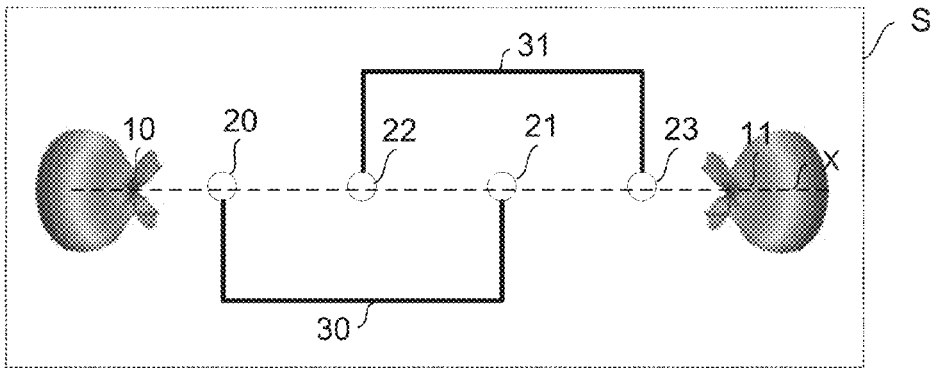
FIG. 6 is a diagram analogous to that of FIG. 5 wherein the beams radiated by the antenna are shown.

A first embodiment is shown by FIGS. 4 to 6.

With reference to these figures, the antenna comprises two excited elements 10 and 11 each connected to two signal feed terminals (not shown) and four reflector elements 20, 21, 22 and 23, all these elements being aligned along an axis X. The reflector elements are disposed between the two excited elements so that the beams of the signals transmitted by the excited elements are radiated outwards in opposite directions as shown by FIG. 6. This is referred to as "back-fire radiation".

The reflector elements and the excited elements are in the form of electric monopoles of length $\lambda/4$ disposed on a substrate with ground plane. Reflector element 22 is placed between reflector elements 20 and 21 and reflector element 23 is placed between reflector element 21 and excited element 11.

Reflector elements 20 and 21 are electrically connected by a transmission line 30 of length L1 and reflector elements 22 and 23 are electrically connected by a transmission line 31 of length L2. The transmission lines are for example microstrip lines implemented on the substrate.

The distance separating reflector element 20 from excited element 10 is equal to $d_1$. The same distance separates reflector element 23 from excited element 11.

The distance separating two consecutive reflector elements is equal to $d_2$. The length L1, L2 of the transmission lines is greater than distance $d_2$.

According to the invention, the reflector elements are coupled so that their radiation is in phase (same phase) in the direction of the maximum required directivity (back-fire radiation). For this purpose, length L1 and L2 of the transmission lines, distance $d_1$ and distance $d_2$ are optimised.

This coupling is for example obtained for signals having a frequency at 5.5 GHz with the following values: $d_1$=5 mm≈λ/10, $d_2$=0.15λ, L1=19.7 mm and L2=27.7 mm.

With these values, a directivity (gain in each of the two directions) in the order of 10.7 dB in the two opposite directions can be expected.

Figure 7:
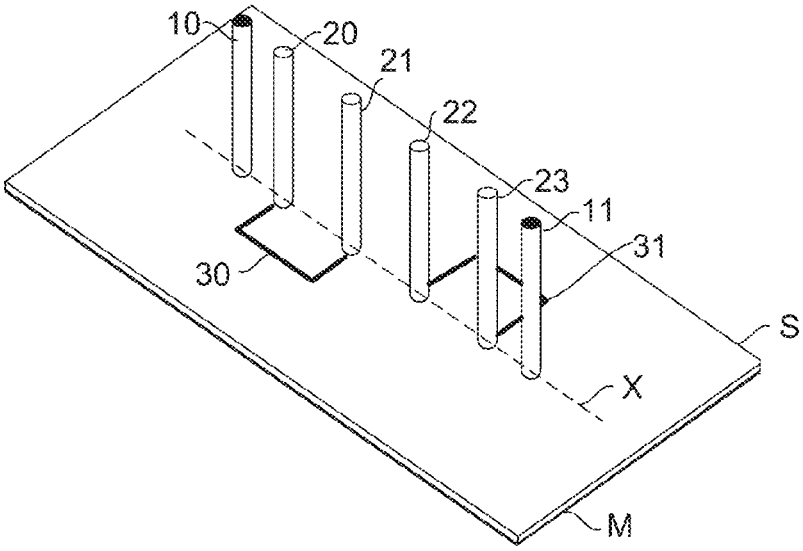
FIG. 7 is a perspective diagram of a multi-sector antenna according to a second embodiment of the invention.
Figure 8:
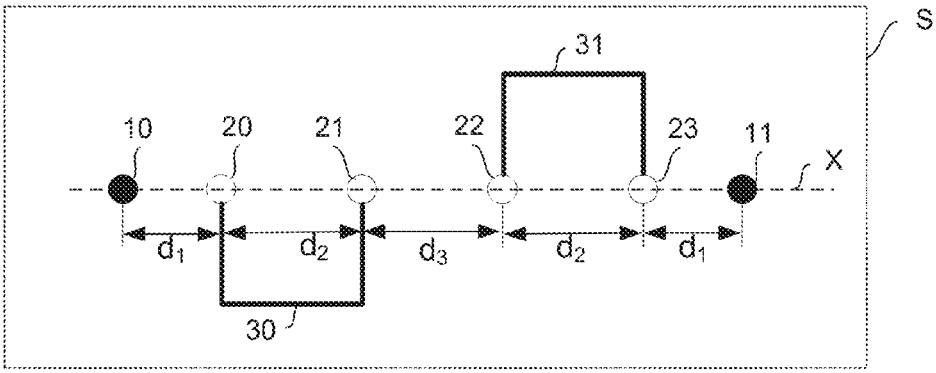
FIG. 8 is a top view of the diagram of FIG. 7.
Figure 9:
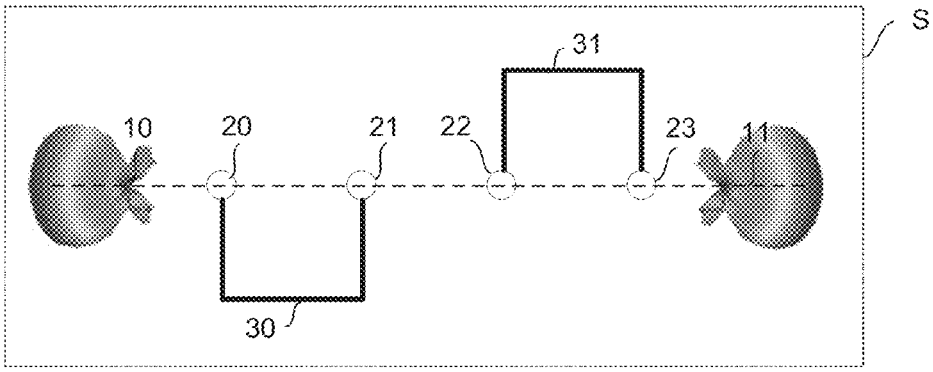
FIG. 9 is a diagram analogous to that of FIG. 8 wherein the beams radiated by the antenna are shown.

A second embodiment is shown in FIGS. 7 to 9. In this embodiment, the reflector elements are disposed and connected differently and the distance between the reflector elements ($d_2$ and $d_3$) is not necessarily constant.

In this embodiment, reflector elements 20 and 21 are adjacent as are reflector elements 22 and 23. $d_2$ designates the distance between reflector elements 20 and 21 and the distance between reflector elements 22 and 23. Reflector elements 21 and 22 are separated by the very small distance $d_3$, less than λ/5, in order to obtain a strong coupling between these two elements even though they are not connected by a transmission line. In FIGS. 7 to 9, $d_3$ is equal to $d_2$ but could be reduced to increase the coupling between reflector elements 21 and 22.

The directivity of the back-fire radiation from the antenna as shown by FIG. 9 can be adjusted by adjusting values $d_1$, $d_2$, $d_3$, L1 and 2.

A maximum directivity of 10.8 dB for signals at 5.5 GHz in the two opposite directions was obtained with the following values: $d_1$=5 mm≈λ10, $d_2$=$d_3$=0.15λ and L1=L2=21.8 mm.

Figure 10:
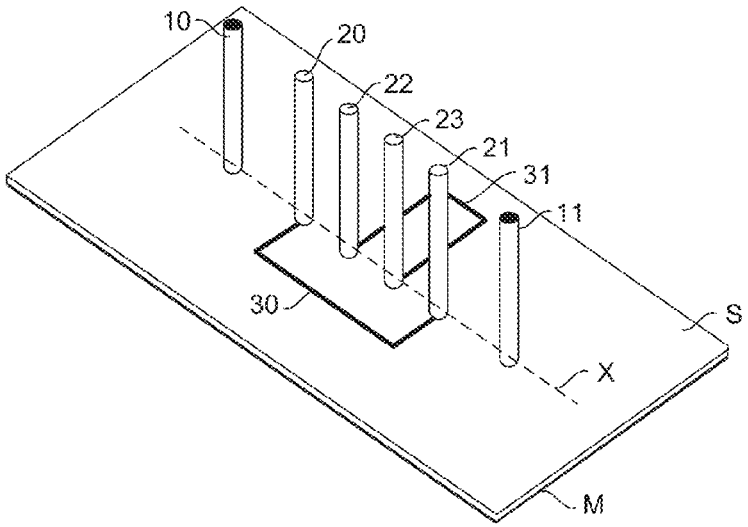
FIG. 10 is a perspective diagram of a multi-sector antenna according to a third embodiment of the invention.
Figure 11:
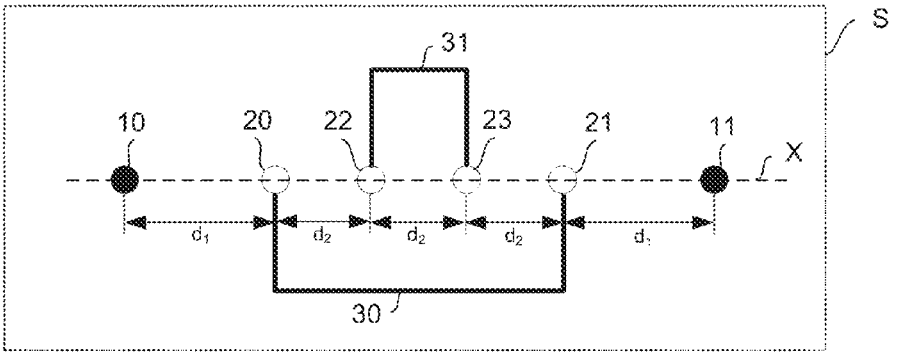
FIG. 11 is a top view of the diagram of FIG. 10.
Figure 12:
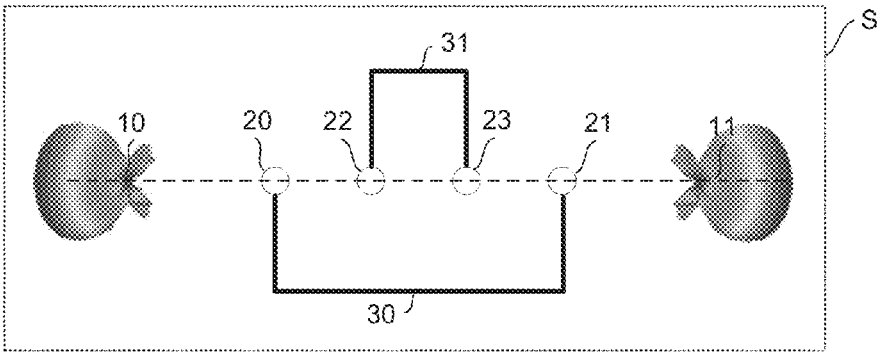
FIG. 12 is a diagram analogous to that of FIG. 11 wherein the beams radiated by the antenna are shown.

A third embodiment is shown in FIGS. 10 to 12. In this embodiment, reflector elements 22 and 23 are placed between reflector elements 20 and 21.

The directivity of the back-fire radiation from the antenna as shown by FIG. 12 can be adjusted by adjusting values $d_1$, $d_2$, L1 and L2.

A maximum directivity of 10.56 dB for signals at 5.5 GHz was obtained with the following values: $d_1$=3 mm≈λ20, $d_2$=0.15λ, L1=33.8 mm and L2=38.9 mm.

These three embodiments present a directive antenna able to transmit simultaneously in two opposite directions.

The directivity of these antennas can be further improved by adding director elements in the direction of radiation. This addition is, however, made to the detriment of the compactness of the antenna.

Figure 13:
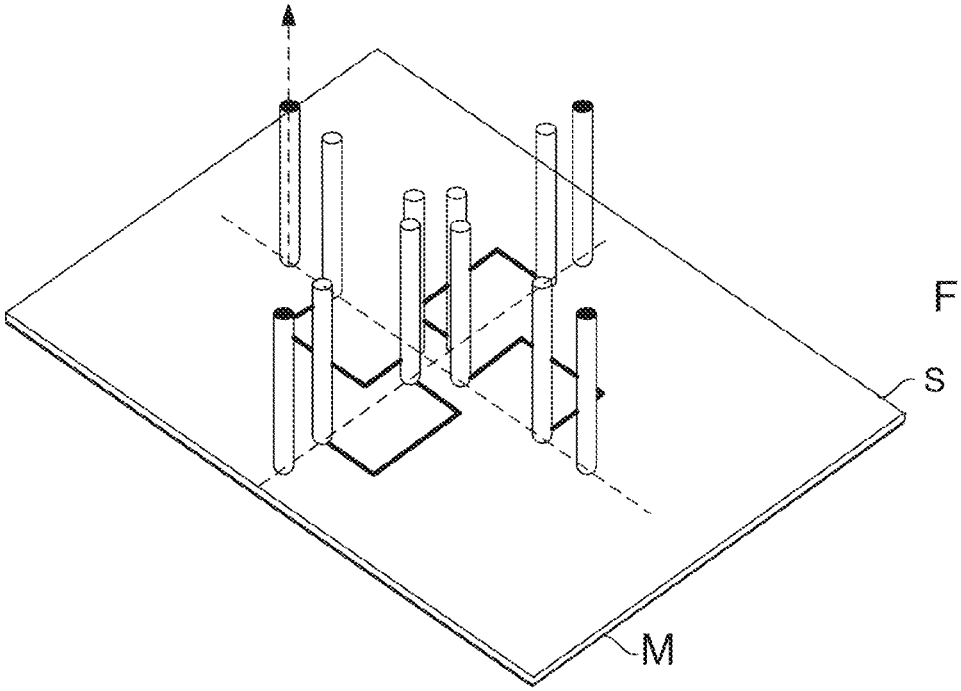
FIG. 13 is a perspective diagram of an multi-sector antenna with four sectors constituted of two antennas as shown in FIG. 7 and angularly offset by 90°.
Figure 14:
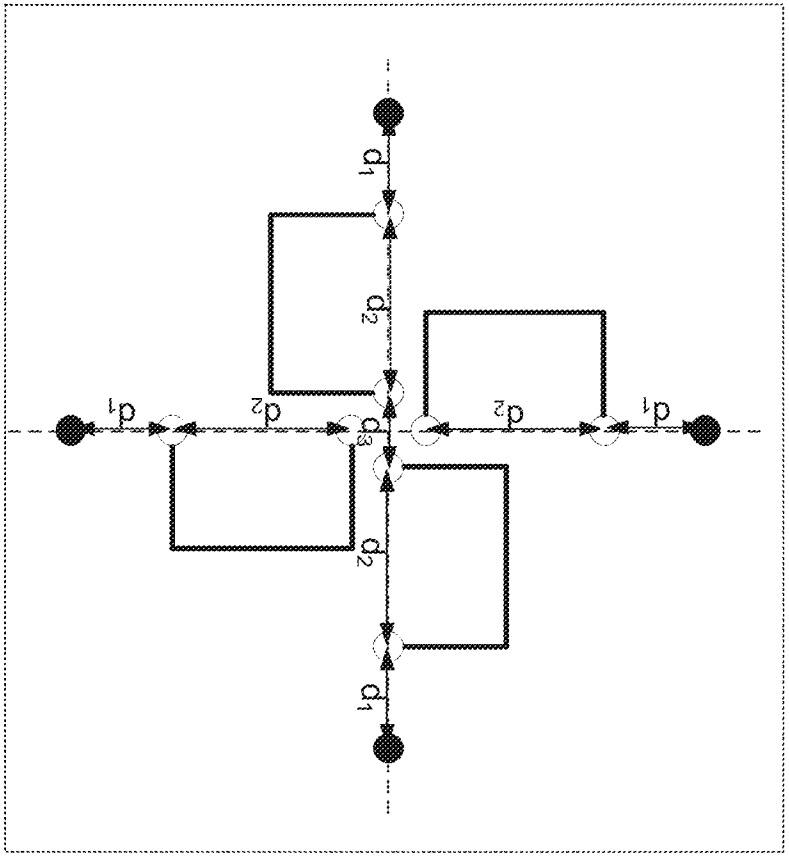
FIG. 14 is a top view of the diagram of FIG. 13.

These antennas can be used to manufacture antenna systems able to transmit in a plurality of directions. An antenna system able to radiate beams in four directions simultaneously is shown in FIGS. 13 and 14.

This system comprises two antennas as shown in FIGS. 7 to 9 angularly offset by 90° and centred on the same point. The axes of the two antennas are therefore perpendicular.

This antenna system can be implemented on a single-layer or multilayer substrate. This system is preferably implemented on at least two layers in order to isolate the first antenna completely from the second antenna and to prevent the transmission lines connecting the reflector elements from crossing.

The embodiments described above have been provided as examples. It is obvious to those skilled in the art that they can be modified notably as regards the number of reflector elements between the excited elements and as regards the shape and the length of the excited elements and the reflector elements.

The invention claimed is:

1. An antenna for radiating in two different angular sectors, the antenna comprising:

first and second active elements each active element being arranged to radiate a signal beam towards a respective angular sector, the different angular sectors being in opposite directions from the antenna with respect to one another and, a plurality of reflector elements, each reflector being configured to reflect signal beams radiated from at least one of the active elements outwards from the antenna towards one of the angular sectors, said plurality of reflector elements are disposed between said first and second active elements, the first and second active elements and plurality of reflector elements being electric monopoles and aligned along an axis of the antenna, and wherein said plurality of reflector elements comprises at least two pairs of reflector elements, the reflector elements of each pair radiating in different angular sectors opposite to one another and being coupled together by a respective transmission line of length such that the reflected radiation of the coupled reflector elements is in phase and a reflector element of a first pair of the reflector elements is disposed between the reflector elements of the second pair.

2. The antenna according to claim 1, wherein the distance between adjacent reflector elements is determined so that the radiation reflected by said at least two coupled reflector elements in each of the opposite directions is in phase.

3. The antenna according to claim 1, wherein the distance between each of the active elements and the respective nearest reflector element of the plurality of reflector elements is determined such that the radiation reflected by said at least two coupled reflector elements in each of the opposite directions is in phase.

4. The antenna according to claim 3, wherein the distance between each of the active elements and the respective nearest reflector element of the plurality of reflector elements is a distance $d_1$ respectively, $d_1$ being less than λ/5, λ being the wavelength corresponding to the frequency of the signal beam emitted by the first and second active elements.

5. The antenna according to claim 1 wherein reflector elements of at least one of the pairs of reflector elements are disposed adjacent to one another.

6. The antenna according to claim 5 wherein reflector elements of each pair of reflector elements are disposed adjacent to one another.

7. The antenna according to claim 5, wherein one of the pairs of the reflector elements is disposed between another pair of the reflector elements.

8. The antenna according to claim 5, wherein one of the pairs of reflector elements is disposed between said a reflector element of another pair of the reflector elements and one of the active elements.

9. The antenna according to claim 1 wherein the distance between two adjacent reflector elements of different pairs of the reflector elements is less than $\lambda/5$.

10. The antenna according to claim 1, wherein the reflector elements are disposed at regular intervals between said first and second active elements.

11. The antenna according to claim 1, comprising at least one director element to direct at least one of the beams in one of said different directions.

12. An antenna system comprising at least two antennas according to claim 1, said antennas being angularly offset so as to radiate beams in at least four different directions.

* * * * *